United States Patent [19]

Abraham

[11] 4,124,126

[45] Nov. 7, 1978

[54] ROLL-OVER MECHANISM

[75] Inventor: Edward D. Abraham, Brecksville, Ohio

[73] Assignee: Carver Foundry Products, Muscatine, Iowa

[21] Appl. No.: 840,121

[22] Filed: Oct. 7, 1977

[51] Int. Cl.[2] ..... B22C 17/08; B65B 69/00

[52] U.S. Cl. ..... 214/1 Q; 214/1 QE; 214/148; 214/310; 214/311; 164/224; 164/292; 164/409

[58] Field of Search ..... 164/205, 224, 375, 409, 164/292, 293, 294, 226, 185, 184, 183, 196, 178, 180, 225, 323, 402, 404, 412, 213, 214, 215, 227, 207, 208, 209; 214/313, 314, 1 Q, 1 QE, 148, 310, 311

[56] References Cited

U.S. PATENT DOCUMENTS

| | | | |
|---|---|---|---|
| 1,855,409 | 4/1932 | Nicholls | 164/185 |
| 3,520,347 | 7/1970 | von Wolff et al. | 164/186 X |

*Primary Examiner*—J. Howard Flint, Jr.
*Assistant Examiner*—John S. Brown

[57] ABSTRACT

A roll-over transfer for foundry equipment is disclosed in which a "C" shaped frame rolls along a base combining translation and rotation between two end positions. The frame is powered by piston and cylinder actuator connected for a cycloidal operation to provide maximum acceleration and deceleration at the ends of the frame travel. Cables are connected between the frame and base to maintain a predetermined relationship between the translating movement and the rotating movement. Primary and supplemental stops cooperate to positively prevent over-travel in the event of a failure in the drive system. A single clamp and draw actuator is centrally mounted on the frame for clamping and drawing foundry equipment. The machine is flexible in use in that it can be loaded and unloaded from any one of three directions in each of its operated positions.

27 Claims, 7 Drawing Figures

ROLL-OVER MECHANISM

BACKGROUND OF THE INVENTION

This invention relates generally to foundry machinery and, more particularly, to a novel and improved roll-over transfer particularly suited for automating the handling of foundry equipment such as molds, core boxes and the like.

PRIOR ART

A roll-over transfer and a roll-over machine are known for transferring and/or rolling foundry equipment, such as molds, core boxes and flasks. One such machine is illustrated in U.S. Pat. No. 1,759,825.

In roll-over machines, the draw cylinders are usually placed to the side of the mold, since, if they were placed directly under the load, the clamp and draw cylinders would swing into the aisles or work area and would present a hazard to the workers. The off-center location of such cylinders requires larger cylinders and guides and a heavier frame. This increases weight and increases manufacturing costs. Further, in such a machine the entire load is usually lifted up several feet and then set down. This requires substantial power and, in the event of failure of an actuator cylinder or hose, the machine can become dangerous to the workmen substantial machine damage can occur. Further, any loose sand tends to fall directly on the draw mechanism causing wear.

Roll-over machines employing four bar linkages have some of the same problems and also require large machine tools for their manufacture. For example, both types of machines use side clamps to retain the molds or core boxes and such clamps tend to bend or damage such clamped equipment.

SUMMARY OF THE INVENTION

A roll-over transfer machine in accordance with the present invention provides operating safety, low manufacturing costs with operating reliability and low maintenance. Further, such machines are arranged for flexibility in use since they can be loaded or unloaded in each of their operated positions from three different directions.

There are a number of aspects to this invention. In accordance with one of the broader aspects of this invention the structure is arranged so that it can be manufactured without the use of large machine tools and does not require extensive machining to produce the various components. Such machines are arranged to allow the maximum use of welding, burning and forming technology to reduce the cost of capital equipment required for manufacture. Further, the structure is arranged to allow the use of relatively small and simple machinery to perform the small amount of machining that is required. For example, the structure is arranged so that drilling and tapping operations can normally be done on a component part using small machine tools before the component part is welded in place in the total assembly.

In accordance with another important aspect of this invention, a simple "C" frame is supported on horizontal tracks for simple rolling motion between two horizontally spaced positions. Such structure provides the roll-over function and the transfer function without requiring substantial power, since the load, for example, a mold, is not raised or lowered significantly during the roll-over transfer operation. Further, since the operation involves rolling rather than sliding friction, power losses are small.

The roll-over transfer operation is powered by a cycloidal drive employing a single relatively small piston and cylinder linear actuator. The cycloidal-type drive connection functions so that the force moment applied by the actuator is a maximum when the frame is at the two extreme positions of its travel and decreases as the frame moves away from such position. In fact the direction of the force moment reverses at a location substantially midway between the limits of frame travel. Consequently, the actuator force is most effective for accelerating and decelerating the frame when the frame is at or adjacent to the ends of its travel. Therefore, the frame drive efficiently operates with a minimum of power to rapidly accelerate the frame back and forth between its two operated positions and to rapidly decelerate the frame as it approaches the end of its movement.

In accordance with another of the broader aspects of this invention a simple structure is provided to stop the frame at the extremes of its travel and a simple cable system functions to maintain positional and rotational orientation of the frame. Such cables also function in cooperation with the stops to absorb the kinetic energy of the frame in the event of malfunction of the drive system. Further supplemental stops are provided to positively prevent damaging or dangerous over-travel in the event of extreme failure conditions.

In accordance with another of the broader aspects of this invention a simple clamping and drawing system is provided which employs a single centrally located piston and cylinder actuator to perform both operations. The central location of such actuator does not present a hazard to personnel since the path of its movement is within the confines of the machine. Such clamping and drawing actuator is connected to operate a simple clamping and drawing system arranged to permit loading and unloading at each position from three different directions. Therefore, a machine incorporating this invention provides a high degree of flexibility in the manner in which the machine can be installed in the total foundry system.

Further the clamping and drawing system is arranged to simply and reliably position equipment being handled during all phases of the operation of the machine.

These and other aspects of this invention are more fully described in the following specification.

DETAILED DESCRIPTION OF THE DRAWINGS

Figure 1:
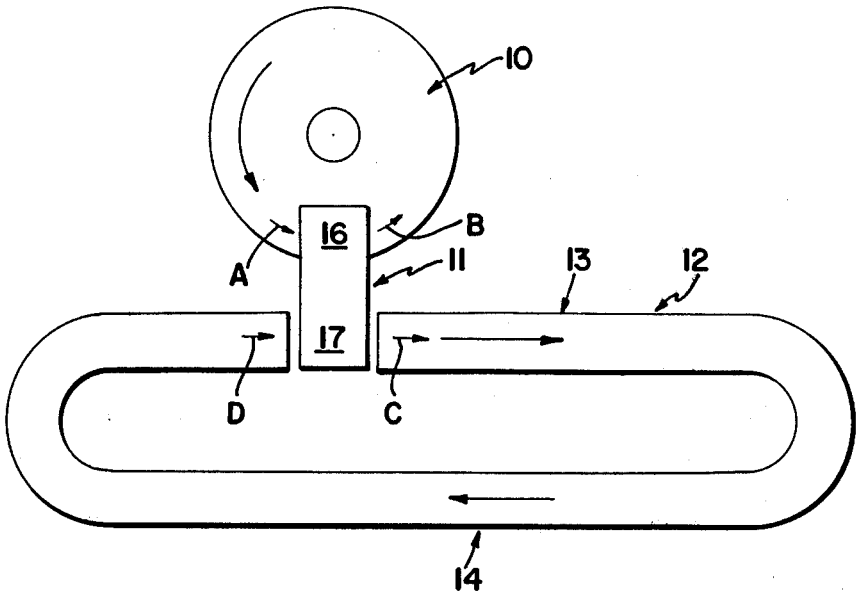
FIG. 1 is a schematic plan view of a foundry system incorporating a cycloid roll-over transfer in accordance with the present invention.

FIG. 1 is a schematic illustration of one type of foundry system in which the roll-over transfer in accordance with the present invention may be installed. In such system a molding loop may be provided by a turntable 10 which functions to progressively move the foundry equipment to a plurality of locations where various operations are carried out and to deliver the particular equipment being handled by the roll-over transfer to the roll-over transfer schematically illustrated at 11.

A second loop 12 is schematically illustrated which may, for example, utilize a gravity conveyor which delivers the foundry equipment to a preparation and assembly area at 13 and subsequently transport the equipment to an area 14 where, for example, molding, pouring and shakeout may be performed. In such system for example, a full mold flask with a pattern plate may be delivered by the turntable 10 to the roll-over transfer 11 as indicated by the arrow A and an empty mold is removed by the turntable from the transfer as indicated by the arrow B.

The roll-over transfer functions to receive the full mold at one end 16 and to transfer the mold or other equipment being handled while rotating it through 180° to a second position at 17. In the position 17 the full mold, for example, is moved into the second loop after drawing the pattern plate as indicated by the arrow C and an empty mold is returned and loaded into the roll-over transfer at the position 17 as indicated by the arrow D.

It should be understood that such system is illustrated only by way of example, and a roll-over transfer in accordance with this invention can be installed in other types of systems involving other types of loading and removal as discussed more fully below.

Referring to FIGS. 2 through 5 the roll-over transfer 11 consists of a base 18 providing a pair of laterally spaced horizontally extending parallel rails 19 along which a "C" shaped frame 21 rolls from its first position 16 illustrated in full line to the second position 17 illustrated in phantom. The C-frame 21 is provided with a pair of semi-cylindrical rolling rims 22 which engage and roll along the tracks 19 and extends through substantially 180° from the location 23 to the location 24. The center of curvature of such rolling rims 22 is located at about 26.

The C-frame is powered for its rotary movement between the two positions 16 and 17 by a simple piston and cylinder and actuator 27 having a cylinder 28 pivotally mounted on the base 18 at 29 and a piston 31 pivotally connected to the C-frame at 32. Preferably the pivot 32 is located between but substantially in alignment with the rolling surface 22 so that the pivot point 32 moves with a cycloidal type movement illustrated by the locus curve 33 of the pivot 32 as the C-frame is powered back and forth between two positions 16 and 17. The pivot 32 moves from the full line position when the C-frame is in position 16 downwardly along the curve 33 to the point 34 at which it is located substantially in the plane of the rails and then upwardly to the left to the position 32', when the C-frame reaches the second position 17.

In the illustrated embodiment the pivot 29 is located vertically below the pivot 32 when the C-frame is in the full line position 16 and the distance between the pivot 29 and the positions of piston pivot at 32 and 32' is equal so that the piston 31 is in the fully extended position when the C-frame is in each of its extreme positions of movement. With the illustrated geometry the force moment applied to the C-frame 21 by the actuator 27 is at a maximum for a given actuator force when the C-frame is in each of its two positions 16 and 17 and the force moment applied for a given actuator force to the C-frame decreases as the C-frame 21 is progressively spaced from such end positions. In fact, the direction of the force moment reverses when the pivot 32 passes through the mid-position at 34.

With this structure, a given pressure supplied to the actuator 27, which causes a given force on the piston, is most effective when the C-frame is at its end travel position or approaches such position. Consequently, the actuator is capable of rapidly accelerating the C-frame when the C-frame commences to move from one of its extreme positions with the acceleration produced by a given pressure or force decreasing as the C-frame moves farther away from such extreme position. However, after the C-frame has rolled past the center position and is approaching the end of its travel, the actuator force again becomes more effective and is utilized to smoothly decelerate the C-frame at it approaches the end of its travel.

The actuator 27 may be supplied with either pneumatic or hydraulic pressure through suitable controls from a suitable source of fluid under pressure, such as a conventional pump and control valves, which are not illustrated for purposes of simplification of this description. Such controls are arranged to forcibly retract the actuator 27 and move pivot 32 from the position shown in FIG. 2 to point 34, to reverse fluid flow to forcibly extend the actuator from point 34 to point 32', and to connect the actuator through suitable flow restricting orifices or the like to control the motion resisting force applied by the actuator so that it will smoothly decelerate and stop as it reaches the opposite position of travel with suitable internal cushions. The kinetic energy of rolling of the C-frame, however, ensures that the system carries through the reversal point at 34 without difficulties.

In order to ensure that the C-frame 21 does not slip on the rails 19 and to ensure that a positive transfer and rotational orientation are maintained, four cables in the preferred embodiment are connected between the base 18 and the C-frame with two located on each side. The connections of the pair of cables on one side of the C-frame is similar to connections of the pair on the other side. Therefore the description of one pair applies equally to the other pair. Other means, such as rack and pinion gearing, linkages, dogs, etc., can be used to ensure positive orientation of the C-frame as a substitute for the cables.

The first cable 36 is connected at one end 37 to the base 18 by a tension-adjusting screw which extends through an upstanding mounting block 38 on the base 18. Suitable nuts are threaded onto the screw 39 so that the cable 36 can be adjusted for tension and position. The opposite end of each cable 36 is connected to the C-frame by an anchoring block 41 in such a manner that tension and position of the cable can be adjusted. When the C-frame 21 is in the position 16, the cable 36 is wrapped around the rolling surface of the C-frame. A second cable 42 is similarly anchored at one end 43 to the base 18 and is similarly anchored at its other end 44 on the C-frame 21. Here again, tension means are provided at the ends 43, 44 of the cable 42.

As the C-frame rolls from the position 16 toward the position 17, the two cables 36 on the opposite sides of the C-frame unwind from around the C-frame and simultaneously the two cables 42 wind up around the C-frame with the amount of unwinding of the cables 36 equaling the amount of winding of the cables 42. Therefore, the C-frame is mechanically and positively prevented from slipping on the rails and a positive mechanical structure is provided to ensure that the C-frame's position and rotational orientation are maintained in a positive manner. Further, the use of the similar but opposite cable connections on each side of the C-frame ensures that the C-frame does not become skewed from its proper position during the rolling movement.

Primary mechanical stop 55 is provided to locate the C-frame 21 in each of its end positions, and supplementary stop 50 functions to ensure that the C-frame cannot, under any circumstances, move an appreciable amount beyond the normal end positions, even in the event of severe failure in the power system. It should be understood that a similar stop system is provided to function at each end of the travel of the C-frame and that the following description describing one of such stop systems, which functions in the frame position 16, applies equally to a similar stop system which functions when the frame is in the other end position 17.

The supplementary stop system 50 includes a pair of stop members 51 and 52 mounted on the base 18 for engagement by a movable stop member 53 mounted on the C-frame. The member 53 is provided with a lower face which engages the stop member 51 when the C-frame reaches the end position 16 and an inclined face which normally leaves a gap between the inclined face and the stop member 52. The stop system 50 is located substantially forward of the location at which the rim 22 engages the track 19 and is substantially spaced horizontally from the mass center of the C-frame, when the C-frame reaches the position 16, so that it normally prevents further rolling movement beyond the normal position 16.

The center of curvature 26 is displaced horizontally from the center of the flask 61 and also from the center of mass of the C-frame which is located approximately at the point 60 so that gravity will maintain the machine in either of its two positions 16 or 17 in the event that power is shut off.

In the event that a hose ruptures or other failure occurs, which prevents the normal deceleration of the C-frame as it approaches the end positions, the supplementary stop system 50 cooperates with the cable system and the primary stop system 55 to prevent damaging or dangerous over-travel.

Under stopping condition, the C-frame is forced by the primary stop system 55 to attempt to stop rotating but the C-frame tends to slide forward and the cables 36 tension to resist such sliding movement and function to absorb kinetic energy, thereby resisting over-travel. In the event of extreme failure conditions, the supplemental stop 50 functions to positively prevent over-travel.

Figure 4:
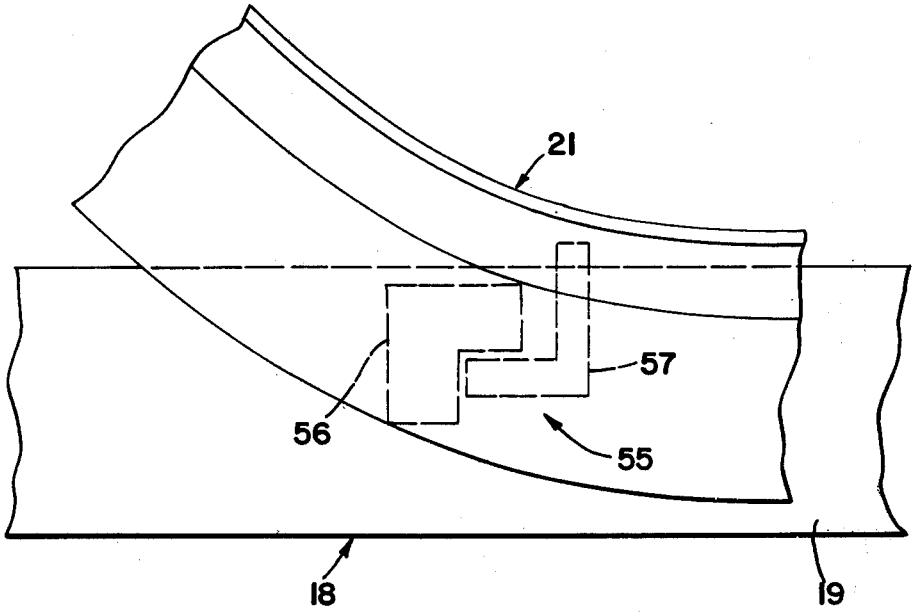
FIG. 4 is an enlarged fragmentary view illustrating the structural arrangement of the positive primary stop to prevent over-travel of the frame.

The primary stop means 55 are best illustrated in FIG. 4 and include a stationary stop member 56 mounted on the base 18 and a movable stop member 57 mounted on the frame 21. The movable member 57 is located so that during normal operation it engages the stationary member 56. In the event of extreme conditions of failure in which the C-frame 21 arrives at the end position 16 with a relatively high velocity, the primary stop system 55 stops rotation of the C-frame 21 but the C-frame tends to slide forward, with the cables extending somewhat, the movable member 53 engages the stationary member 21 and positively prevents substantial over-travel. Therefore, the C-frame is positively stopped to prevent substantial damage to the machine or hazard to personnel.

The clamp and draw system is best illustrated in FIGS. 2, 3, 5 and 6. In the illustrated embodiment, the system operates to clamp a typical mold and pattern plate and to draw such pattern plate from the mold. It should be understood, however, that other types of operation can be performed by the machine.

Figure 2:
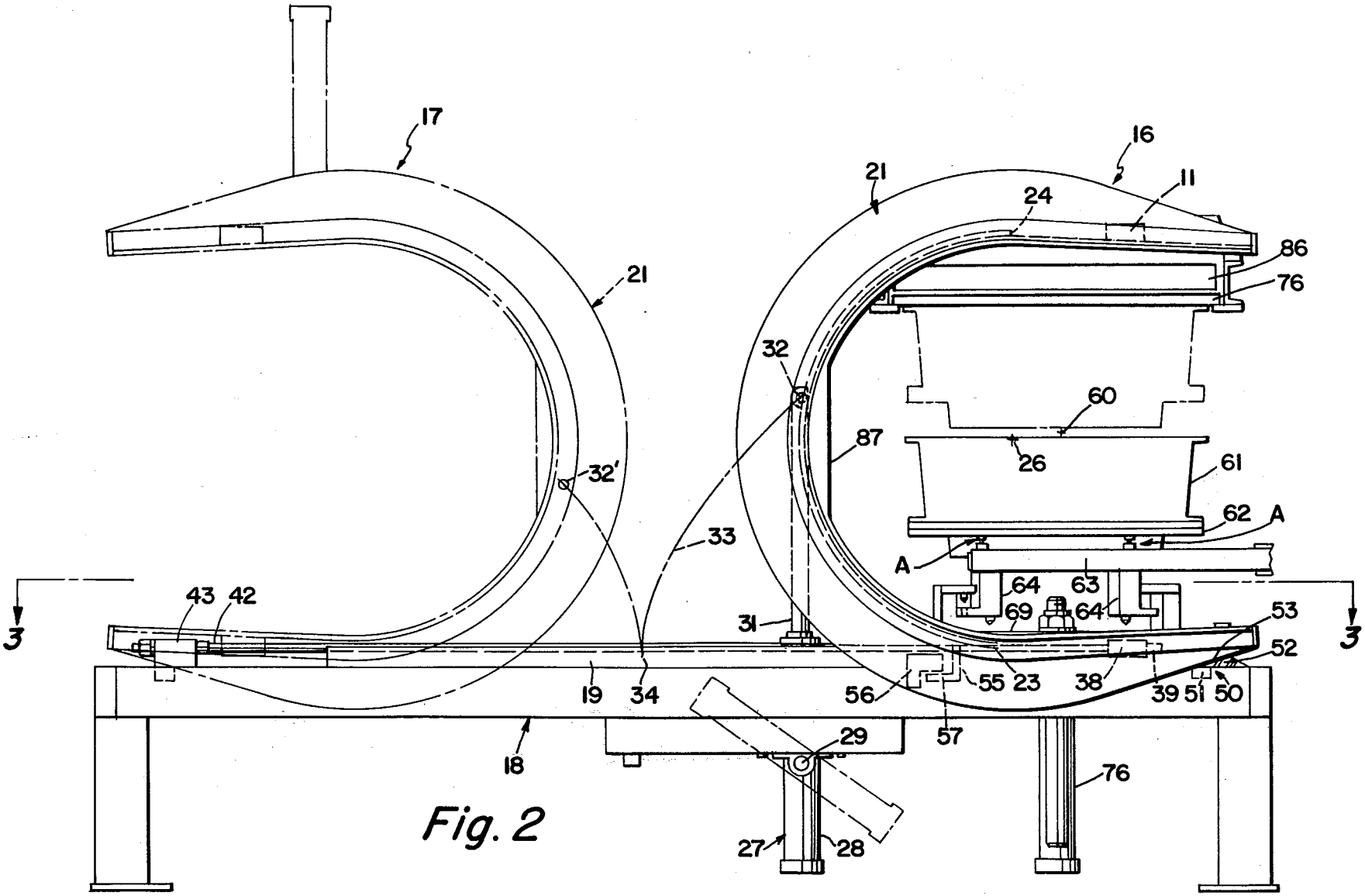
FIG. 2 is a side elevation illustrating in full line the roll-over transfer frame in one extreme position of its travel and illustrating such frame in phantom at its other position of travel.

Referring to FIG. 2, a mold 61 resting on a pattern plate 62 is supported on spaced arms 63 of the table 10 and is carried by such arms to a delivery position within the C-frame 21. Projecting downwardly from the pattern plate 62 are four similar support legs 64 having a structure best illustrated in FIG. 6. Each leg is provided with a depending pin 66 having a conical end 67 proportioned to extend into an associated tubular bushing 68 mounted on a clamp and draw plate 69. Each support leg 64 is also provided with a lateral projection 71 providing a tubular bushing 72 proportioned to receive a depending pin 73 carried by an upstanding leg 74 which is also mounted on the clamp and draw plate 69.

Figure 3:
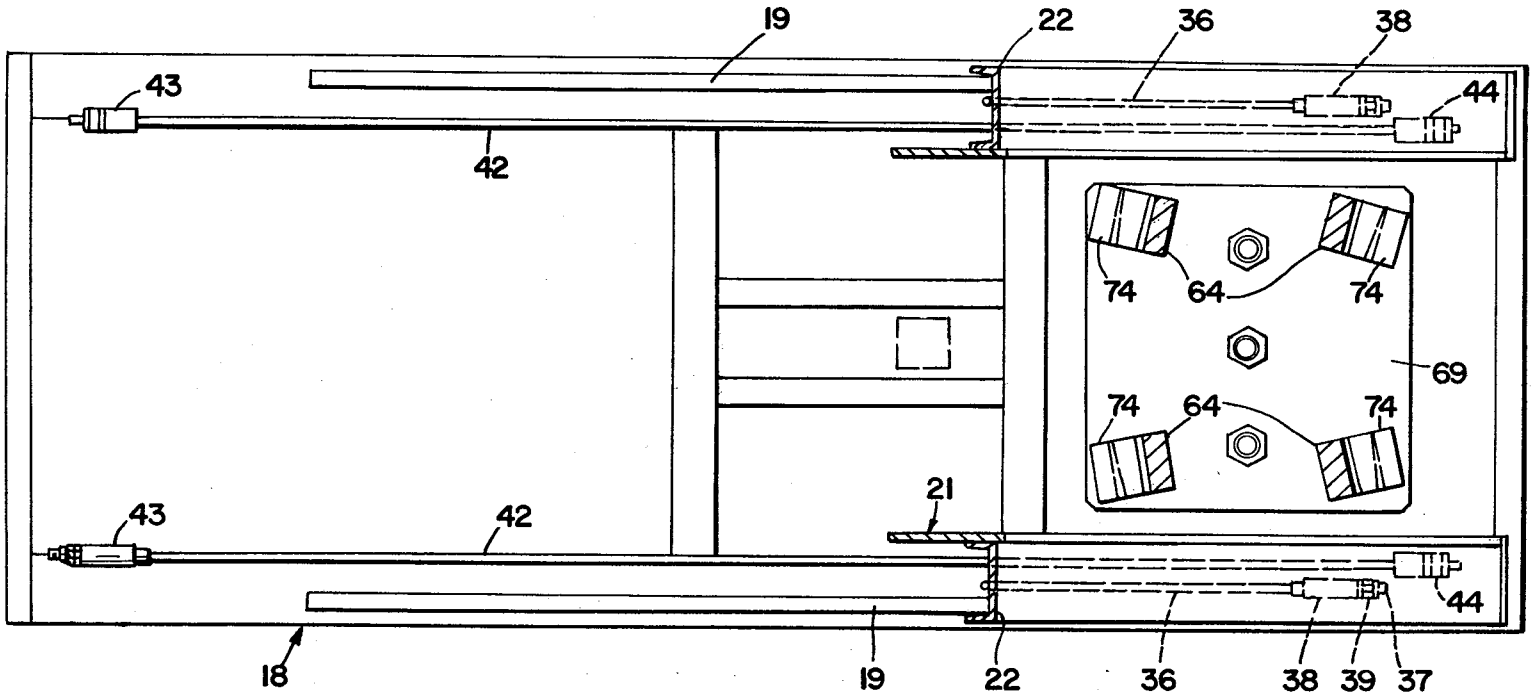
FIG. 3 is a schematic plan view partially in section illustrating the cable system for controlling the frame position and the general arrangement of the clamping and drawing system.

The four similar support legs 64 and upstanding legs 74 are located as best illustrated in FIG. 3, so that the arms 63 can carry a pattern plate 62 and mold 61 with pivotal movement about the central axis of the table 10 to the delivery position illustrated without interference. When the pattern plate is resting on the arm 63, the depending pins 73 are spaced above the associated bushings 72 and the pins 66 are spaced above the associated bushings 68 so that the pattern plate is free to move into and out of the delivery position.

An adjustment is provided between table arms 63 and the pattern plate 62. The adjustment may take any structural form. Preferably, a bushing and pin arrangement is provided, as indicated at A in FIG. 2. The adjustment is to ensure that the pattern is properly supported in a level position.

Figure 5:
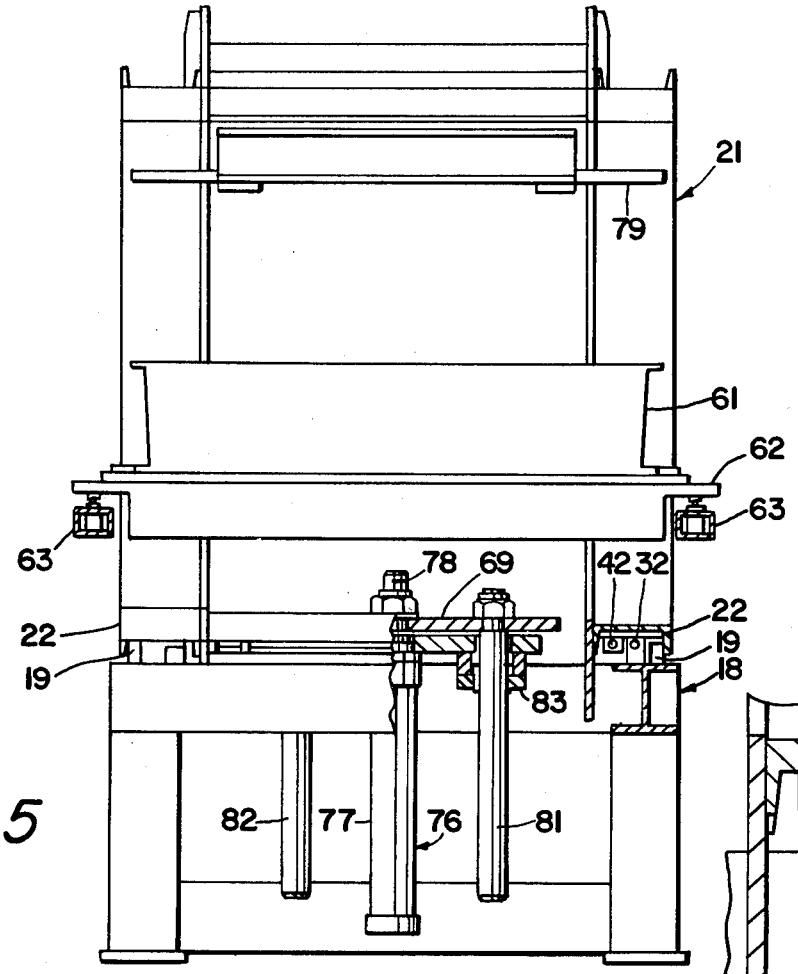
FIG. 5 is an end view illustrating a clamping and draw actuation system.
Figure 5A:
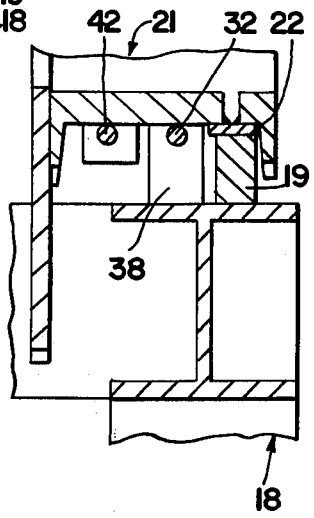
FIG. 5*a* is an enlarged fragmentary view illustrating the track and frame rim structure and the anchoring of the cables.

After the mold and pattern plate are properly positioned by the arms 63, the clamp and draw plate 69 is raised by a piston and cylinder actuator 76 (best illustrated in FIG. 5). Such actuator provides a cylinder 77 mounted on the C-frame 21 and provides a piston 78 connected to the clamp and draw plate 69 and is operable when the actuator extends to move the clamp and draw plate 69 toward the opposite side of the C-frame to a clamping position for lifting and clamping the mold 61 and pattern plate 62 against a bottom board 79. Guide rods 81 and 82 are mounted on the clamp and draw plate 69 and extend through guide bearing assemblies 83 to ensure that the clamp and draw plate moves with straight line movement when the actuator 76 is operated.

Figure 6:
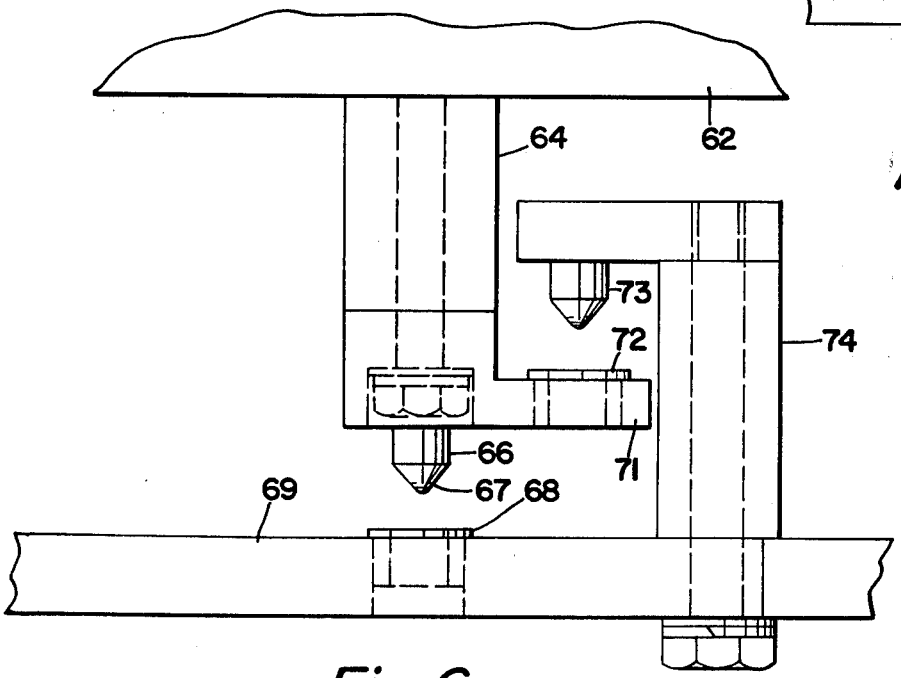
FIG. 6 is an enlarged fragmentary view of the structure for positioning and controlling the load during the clamping and drawing operations and which permits the load to be moved in and out of the machine.

During the initial portion of the movement of the clamp and draw plate 69 from the position of FIGS. 2 and 6, the bushings 68 move up and around the pins 66.

Any small misalingment which may exist is automatically eliminated by the conical ends 67 functioning as camming surfaces to cause the pattern plate 62 to move to the correct position of exact alignment. After the pins 66 are located within the bushings 68, continued upward movement of the clamp and draw plate 69 causes the pattern plate 62 and mold to be moved upwardly to the phantom line position in which the upper side of the mold 61 is engaged by the bottom board 79 and the assembly is clamped against rollers 86 mounted on the opposite side of the C-frame.

While the mold and pattern plate are gripped or clamped, the actuator 27 operates to invert and translate the C-frame from the position 16 to the delivery position 17. A deflector plate 87 on the C-frame prevents loose sand or other material from dropping down onto the actuator 27 or other operating mechanisms on the machine during the roll-over transfer operation.

After inversion, gravity holds the mold 61 against the bottom 79 and the draw operation is accomplished by retracting the actuator 76 causing the clamp and draw plate to be raised through a limited distance until the bushings 72 receive the pins 73. During such initial movement, the pattern plate remains with the mold. After such initial movement, continued retraction of the actuator 76 causes the pattern plate to be drawn away from the mold to complete the draw operation.

Once the pattern plate is clear of the mold 61, the mold is rolled out of the C-frame on the bottom board 79, as indicated in FIG. 1 by the arrow C, onto the loop 12 and an empty flask and bottom board is carried in from the opposite side of the C-frame and is positioned for gripping, as indicated by the arrow D. The actuator 76 is then extended to lower the pattern plate onto the empty flask and to clamp the empty flask against its bottom board so that the empty flask and pattern plate can be carried by the roll-over transfer back to the position 16.

Retraction of the actuator 76 after the C-frame has reached the position 16 causes the flask and pattern plate to drop down onto the arms 63 leaving the bottom board in the position illustrated in FIG. 2. During the retraction of the actuator 76 while the frame is in position 16, gravity maintains the pins 66 in their associated bushings 68 and the weight of the pattern plate 62 and flask is carried directly through the bushings 68 to the clamp and draw plate 69. When the pattern plate and flask are lowered with the plate 69 until the pattern plate engages the arms 63 to prevent further downward movement with the clamp and draw plate, continued retraction of the actuator 76 causes the bushing 68 to move off the pins until the elements assume the position of FIG. 6. In this position, the system is free for indexing movement of the table 10 to move the flask and pattern plate out of the C-frame and to deliver a subsequent pattern plate and flask into position for roll-over transfer.

It should be understood that, even though the loading and unloading of the roll-over transfer in accordance with the present invention is illustrated as substantially lateral with respect to the C-frame involving movement in one side and out of the other side, the loading and unloading can also be accomplished with appropriate modification of the supporting system, in a direction of the plane of the C-frame. Consequently, the loading and unloading can be arranged to be from any one of three directions at both of the end positions of the roll-over transfer and a roll-over transfer incorporating the present invention is very flexible in the manner in which it can be installed in a foundry system.

It should be noted that a single actuator 76 provides for the clamping and drawing functions and that such actuator is efficiently located substantially at the center line of the flask 61. Such actuator, however, does not provide a hazard, since it remains within the confines of the machine as the C-frame rolls between the two extreme positions of its travel and does not swing out into aisles or work areas where it could present a hazard to personnel.

In order to provide easy maintenance, the rails 19 are preferably replaceable and are bolted to the base 18. Similarly, the rims 22 are plug welded to the C-frame and, if wear occurs, it can be removed and replaced without difficulty.

Although a preferred embodiment of this invention is illustrated, it is to be understood that various modifications and rearrangements may be resorted to without departing from the scope of the invention disclosed and claimed.

I claim:

1. A roll-over machine for foundry equipment comprising a frame movable through substantially 180° between two positions, clamp and draw means on said frame movable from an equipment loading position in which foundry equipment may be loaded into said frame or removed therefrom and a clamp position, said clamp and draw means providing first and second opposed and spaced supports, said first support operating in response to movement of said clamp and draw means from said loading position to engage and support a two piece item of foundry equipment and to thereafter move such equipment to the clamp position for inversion as said frame turns through 180°, said second support operating to engage, and draw one of said pieces of equipment from the other in response to movement of said clamp and draw means from said clamp position after inversion of said frame.

2. A roll-over machine as set forth in claim 1 wherein said first and second spaced supports include projections and associated recesses which interfit in operation to positively locate said foundry equipment during clamping and drawing operations.

3. A roll-over machine as set forth in claim 2 wherein said projections are cylindrical pins, and said associated recesses are bushings proportioned to receive said pins, associated said pins and bushings being spaced from each other when said frame is in one position and said clamp and draw means is in said loading position.

4. A roll-over machine as set forth in claim 1 wherein said clamp and draw means is powered by an actuator located substantially in alignment with the center of said item of foundry equipment support on said frame.

5. A roll-over machine as set forth in claim 4 wherein said frame is supported on a base and moves horizontally along said base as it moves between said two positions, and said horizontal movement moves said actuator along a path which remains over said base.

6. A roll-over machine as set forth in claim 1 wherein said machine includes a base, said frame rolls along said base and moves horizontally between said two positions, said frame being generally "C" shaped and being capable in each position of being loaded and unloaded from three different directions.

7. A roll-over machine for foundry equipment comprising a base, a frame mounted on said base for turning movement through substantially 180° between two positions, clamp and draw means on said frame operable from a retracted position in which items of foundry equipment are loaded and unloaded to an extended position in which such items are clamped for roll-over, said clamp and draw means including opposed first and second supports located when in said retracted position and said frame is in one of said two positions to allow loading and unloading of items of foundry equipment consisting of at least one or more parts, said first support engaging and supporting said equipment in response to movement of said clamp and draw means from said retracted position and operating thereafter to clamp said equipment for roll-over upon movement to said extended position, said second support operating after roll-over to engage and support one of said parts in response to movement of said clamp and draw means from said extended position and to thereafter draw said parts apart as movement continues toward said retracted position, and a piston and cylinder actuator connected to move said clamp and draw means between said retracted and extended positions.

8. A roll-over machine as defined in claim 7 wherein said frame has means supporting a bottom board which comprises one of said parts.

9. A roll-over machine as set forth in claim 7 wherein said actuator is located substantially in alignment with the center of said equipment when said equipment is supported on said frame.

10. A roll-over machine as set forth in claim 9 wherein said frame rolls horizontally on said base as it moves between said two positions causing movement of said actuator along a path of movement which remains substantially over said base.

11. A roll-over machine as set forth in claim 10 wherein a second actuator is connected between said base and frame and moves said frame between said two positions.

12. A roll-over machine as set forth in claim 11 wherein said second actuator is a piston and cylinder actuator and is connected to said frame by a pivotal connection which moves substantially along a cycloidal path as said frame rolls between said two positions.

13. A roll-over machine as set forth in claim 12 wherein means is connected between said frame and base to maintain a fixed relationship between the horizontal movement and turning movement of said frame as it moves between said positions.

14. A roll-over machine as set forth in claim 13 wherein said means connected between said frame and base comprise cables.

15. A roll-over machine as set forth in claim 13 wherein primary mechanical stop means are provided on said base and frame operable to stop said frame in each of said two spaced positions under normal operations, and secondary stop means are provided on said frame and base operable to positively prevent substantial over-travel of said frame in the event that said frame arrives at either of said two positions with excessive velocity.

16. A roll-over transfer for foundry equipment comprising a base, a frame supported on said base for substantial horizontal rolling movement between two spaced positions, said rolling movement causing said frame to turn through substantially 180° as it moves between said positions, clamp and support means on said frame operable to receive and clamp an item of foundry equipment while said frame is in one of said positions, to support said equipment for inversion thereof as said frame moves to the other of said positions and to release inverted equipment for removal at said other position, and a linear actuator connected between said base and frame operable to apply a force movement to said frame which is a maximum as said frame moves from said one position, decreases as said frame moves to a near mid-position in which said force movement reverses and increases as said frame moves from said mid-position to said other position whereby said actuator is operable to provide a maximum of acceleration of said frame as said frame commences to move from said one position and a maximum deceleration of said frame as said frame approaches said other position.

17. A roll-over transfer as set forth in claim 16 wherein means is connected between said base and frame to maintain a predetermined relationship between said horizontal rolling movement and said turning of said frame.

18. A roll-over transfer as set forth in claim 16 wherein said frame has a center of mass spaced from its rolling center and located to maintain said frame in each of said two spaced positions.

19. A roll-over transfer as set forth in claim 16 wherein primary mechanical stop means are provided on said base and frame operable to stop said frame in each of said two spaced positions, and supplemental stop means are provided on said base and frame to positively prevent substantial over-travel of said frame in the event that said frame arrives at either of said two spaced positions with excessive velocity.

20. A roll-over transfer comprising a base providing support rails, a transfer frame supported on said rails for rolling and translating movement between spaced first and second positions, said frame providing support means for supporting an object while said frame rolls between said positions and operating to turn and translate said object as said frame rolls between said positions, a linear actuator connected between said base and frame operable to move said frame between said positions, the connection between said actuator and said frame moving substantially with a cycloidal motion which reverses when said frame is substantially midway between said positions, said actuator producing force moments on said frame which are greatest when said frame is at each of said positions and decreases as said frame moves away from said positions, said actuator being operable to produce high accelerations as said frame moves from either position and high deceleration as said frame approaches either position, and control means interconnected between said frame and base maintaining the predetermined relationship between the translating movement and rotational movement of said frame as said frame moves between said positions.

21. A roll-over transfer as set forth in claim 20 wherein said control means are cables connected between said frame and base.

22. A roll-over transfer as set forth in claim 21 wherein primary stop means are provided on said frame and base which engage when said frame reaches each of said first and second positions to prevent over-travel during normal operation.

23. A roll-over transfer as set forth in claim 22 wherein said means cooperates with said primary stop means to resist over-travel of said frame.

24. A roll-over transfer as set forth in claim 23 wherein supplemental stop means are provided on said frame and base which engage in the event a predetermined over-travel of said frame beyond said first and second positions and positively function to prevent excessive over-travel.

25. A roll-over transfer for foundry equipment comprising a base, a frame supported on said base for rolling movement between two horizontally spaced positions, said rolling movement causing said frame to turn through substantially 180° as it moves horizontally between said positions, clamp and support means on said frame operable to receive and clamp an item of foundry equipment while said frame is in one of said positions, to support said equipment for inversion thereof as said frame moves to the other of said positions and to release the inverted equipment for removal at said other position, power means connected to drive said frame between said two spaced positions, primary mechanical stop means on said base and frame operable to stop said frame in each of said two spaced positions under normal operation, and secondary stop means on said frame and base operable to positively prevent substantial over-travel of said frame in the event said frame arrives at either of said two spaced positions with excessive velocity.

26. A roll-over transfer as set forth in claim 25 wherein said primary stop means are located to cause a sliding movement of said frame when over-travel tends to occur, and said secondary stop means are spaced from said primary stop means.

27. A roll-over transfer as set forth in claim 26 wherein means is connected between said frame and base to control the relationship between said horizontal movement and said turning movement, said means also cooperating with said primary stop means to resist over-travel of said frame.

* * * * *

UNITED STATES PATENT AND TRADEMARK OFFICE

CERTIFICATE OF CORRECTION

PATENT NO. : 4,124,126

DATED : November 7, 1978

INVENTOR(S) : Edward D. Abraham

It is certified that error appears in the above-identified patent and that said Letters Patent are hereby corrected as shown below:

Column 10, line 5 change "movement" to --moment--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*